US005353894A

United States Patent [19]

Garrido et al.

[11] Patent Number: 5,353,894

[45] Date of Patent: Oct. 11, 1994

[54] GEARED ELEVATOR MACHINE

[75] Inventors: Alfonso Garrido; Jose Sevilleja, both of Madrid, Spain

[73] Assignee: Otis Elevator Company, Farmington, Conn.

[21] Appl. No.: 44,335

[22] Filed: Apr. 7, 1993

[30] Foreign Application Priority Data

Apr. 14, 1992 [ES] Spain ..... 9200810

[51] Int. Cl.[5] ..... B66B 11/04

[52] U.S. Cl. ..... 187/254; 74/505

[58] Field of Search ..... 187/20; 74/505, 89.14, 74/425

[56] References Cited

U.S. PATENT DOCUMENTS

| | | | |
|---|---|---|---|
| 1,762,790 | 6/1930 | Odenbach et al. | 74/425 |
| 3,408,881 | 11/1968 | Grube | 74/505 |
| 3,965,759 | 6/1976 | Plotnikov et al. | 74/89.14 |
| 4,026,163 | 5/1977 | Merkert | 74/425 |
| 4,688,660 | 8/1987 | Kaneko | 187/20 |

*Primary Examiner*—Kenneth W. Noland

[57] ABSTRACT

The input axle (1) of an elevator machine transmits a rotational movement to an output axle (13) by means of a conventional worm gear/ring gear device (10), (11) or similar device, the output axle (13) penetrating a sheave (12) which carries the cable that suspends a cabin. The output axle (13) is supported by at only two points (3,4) which are collateral to the sheave (12), and has a projecting end that penetrates and supports the ring gear (11).

4 Claims, 4 Drawing Sheets

GEARED ELEVATOR MACHINE

TECHNICAL FIELD

This invention refers to elevators and more particularly to improved geared elevator machines.

BACKGROUND ART

Some elevators are driven by a motor having a geared speed reducer attached thereto. The motor rotor rotates at a relatively fast first speed and either is or directly interacts with an input axle. The input axle is attached to a pinion-ring gear mechanism, or worm gear/ring gear mechanism, or other speed reducer, to an output axle that carries a drive sheave. The drive sheave supports and provides motive force to elevator suspension cables. The output axle usually rotates at a relatively slower second speed.

At present, the output axle carrying the sheave has three supports; one at either end thereof and one at a central point. These supports encounter expensive and complex on-site adjustment problems which if not satisfactorily resolved cause material fatigue.

Utilizing a sectioned output axle to avoid misalignment is not a good solution because it requires an oversized Cardan or other universal joint; moreover, vibration and noise problems would arise.

Eliminating the central support may cause the formation of large flexions which should also have vibration, noise and fatigue problems.

DISCLOSURE OF INVENTION

Therefore, it is an object of the invention to provide an gear reduced elevator machine: having a reliable construction with only one machined part; which flexes minimally; which eliminates alignment problems; is economical to construct; and minimizes the need for reinforced or machined supports.

According to the invention, an elevator machine supports an output axle at only two points which are located one on either side of a sheave, the output axle having a portion projecting through a speed alteration device that interacts with an input axle.

The supports are disposed in a monoblock housing and therefore, since the housing consists of only one part, bearings for the two support points are easily installed and seats for the bearings are easily machined.

Flexion that may form in the axle, between the supports, is compensated, at least partially, by the portion of the axle projecting through the reduction gear mechanism.

The foregoing and other objects, features and advantages of the present invention will become more apparent in light of the following detailed description and accompanying drawings.

BEST MODE FOR CARRYING OUT THE INVENTION

Figure 1:
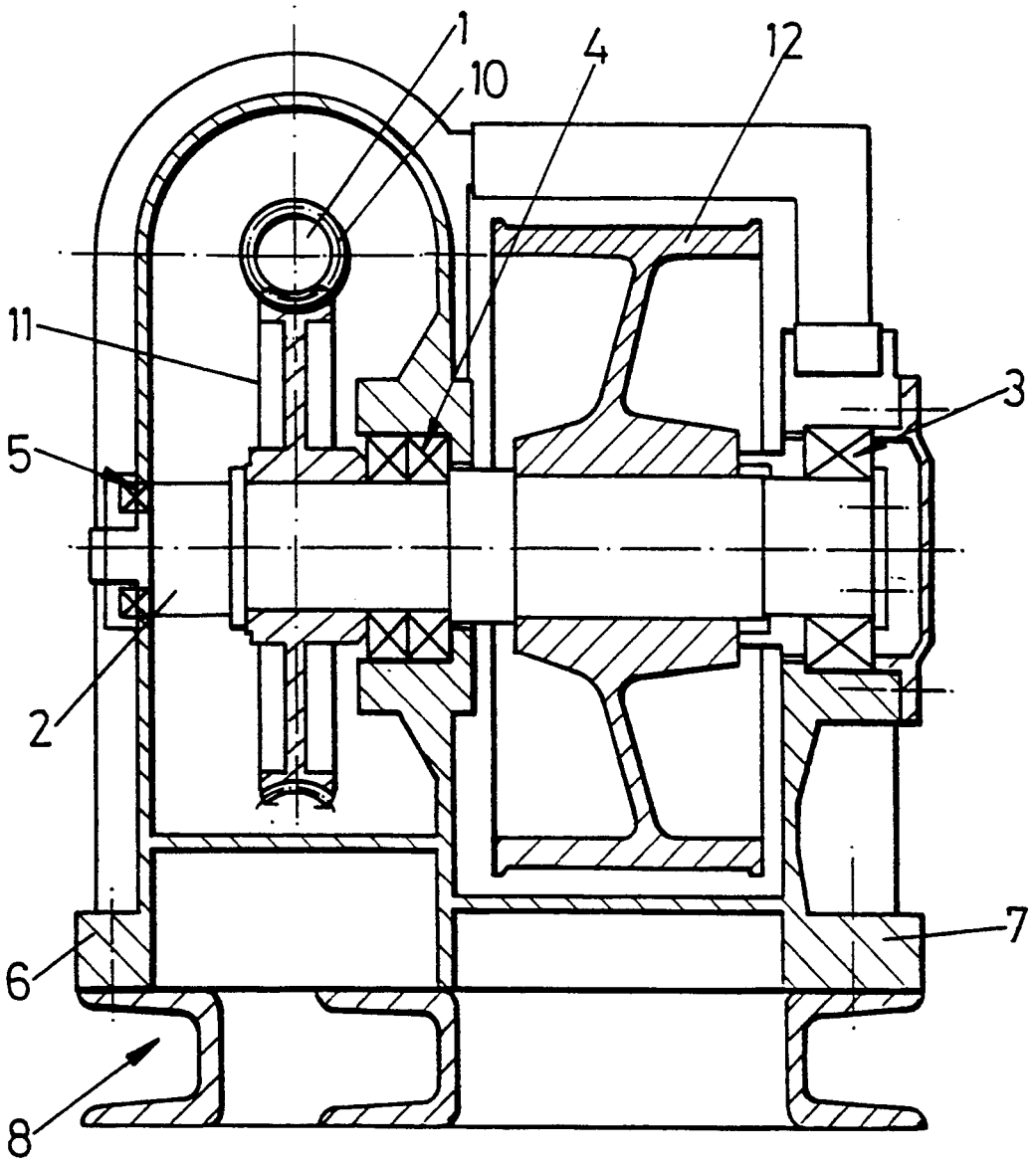
FIG. 1 PRIOR ART
FIG. 1 is a diagrammatic view of a longitudinal section of a prior art system for supporting the axle of a widely employed elevator machine.

Referring to FIG. 1 in which the present state of the art is illustrated, input axle 1 causes the slow rotation of output axle 2 which is supported by the three support bearings 3, 4 and 5 on bed 6 and exterior support 7. Bed 6 and exterior support 7 are to be duly stabilized on a sturdy base 8 of the machine room, so that output axle 2 is aligned and stabilized.

Rotary movement from input axle 1 to output axle 2 is transmitted by worm gear 10 and ring gear 11 as is known in the art. Ring gear 11 is penetrated by output axle 2 between bearings 4 and 5, while the sheave 12 is penetrated by the output axle 2 between bearings 3 and 4.

As noted above, the disposition of three support points 3, 4 and 5 for output axle 2 of the elevator machine leads to on-site alignment problems; bed 6 and exterior support 7 must be machined precisely, since there may be fatigue problems of output axle 2.

Figure 2:
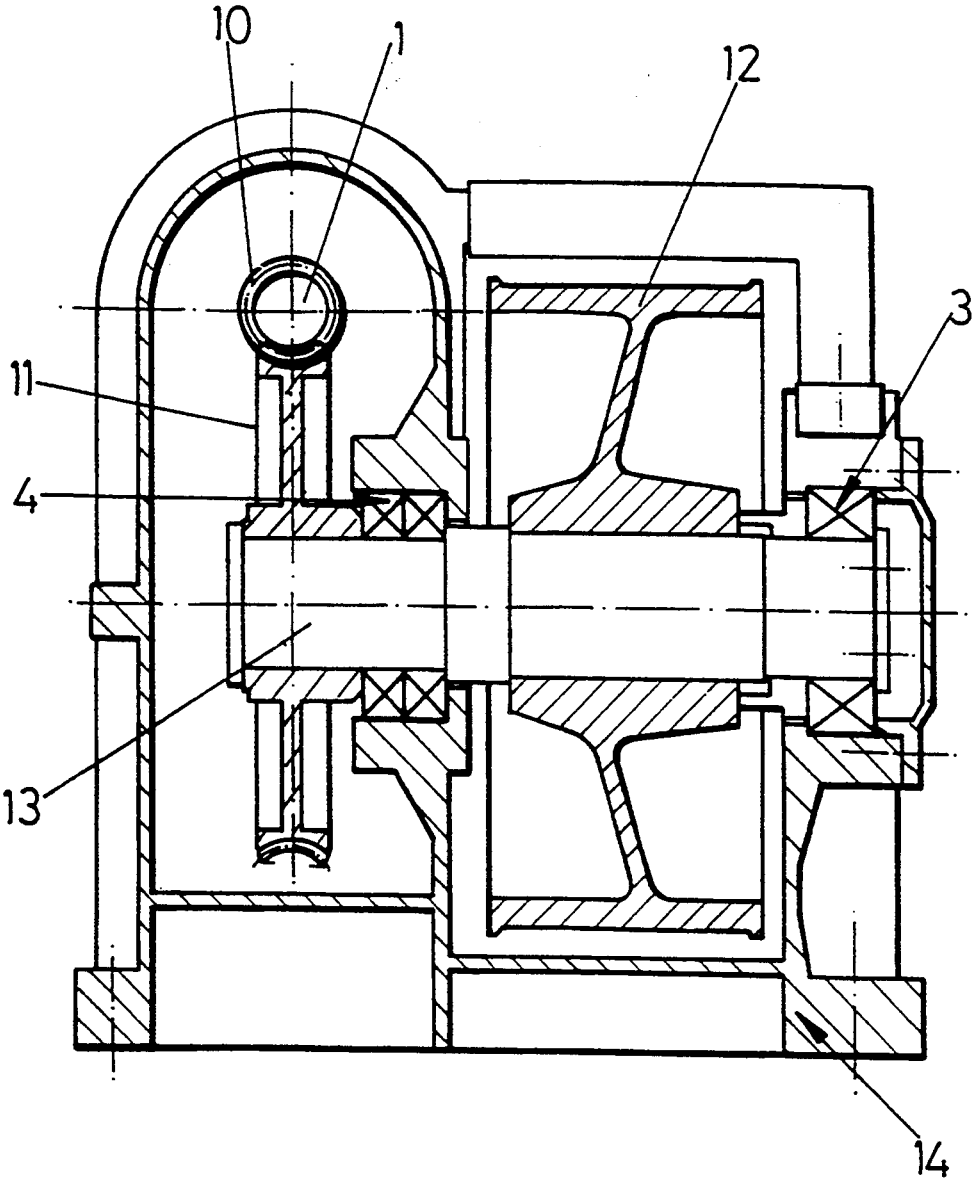
FIG. 2 is a view similar to that shown in FIG. 1, with the axle resting on the bed in the manner proposed by the invention.
Figure 4:
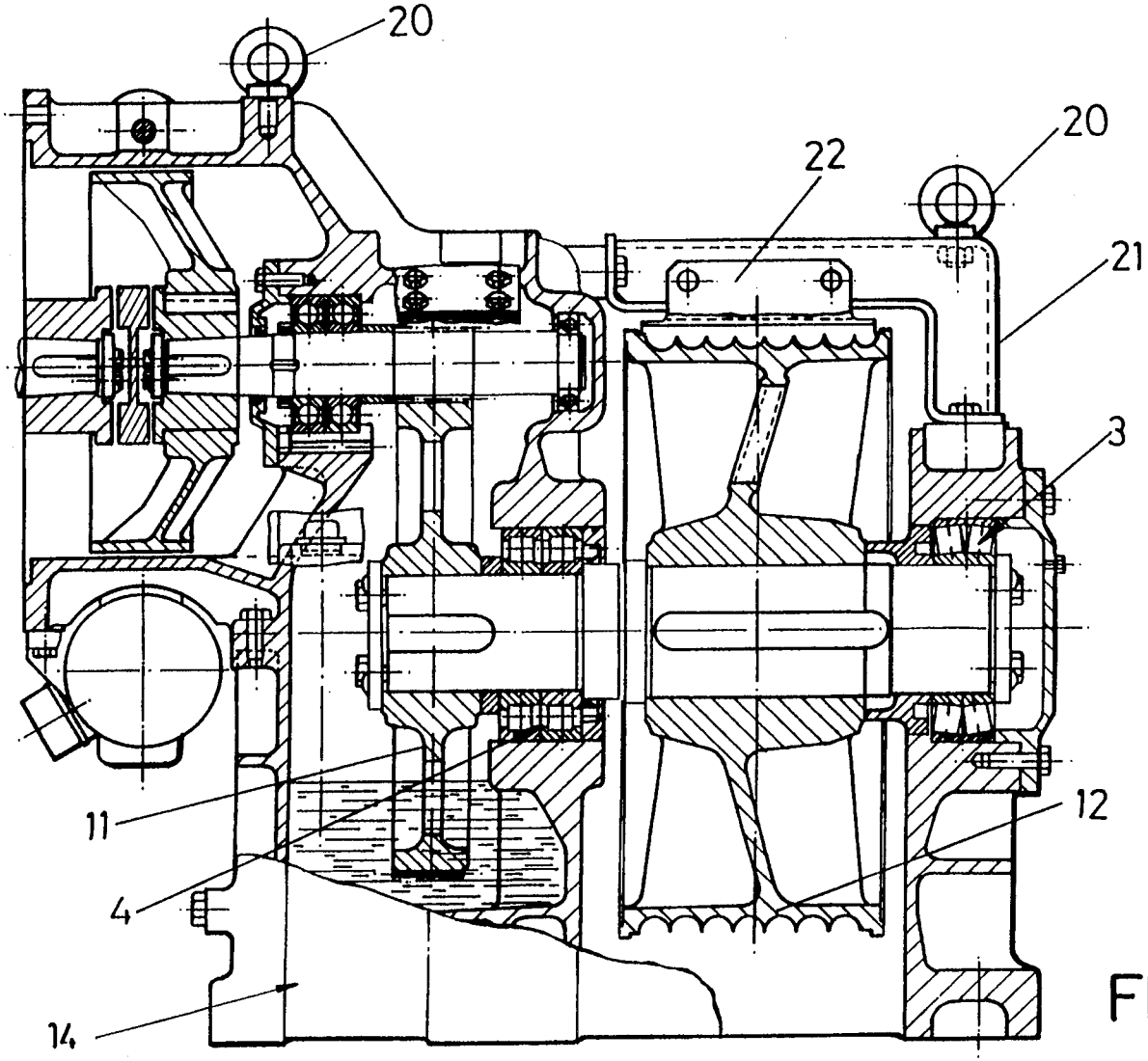
FIG. 4 is a detailed sectional view of the reducer for the elevator machine with exterior support according to the invention.

Referring to FIGS. 2 and 4, the present invention is shown. Output axle 13 is of lesser length than prior art output axle 2 since axle 13 only rests on two bearings 3, 4. The output axle supports and is fixedly attached by conventional means to sheave 12. Ring gear 11 is fixedly mounted by conventional means on the projecting portion of output axle 13, This disposition allows for the elimination of exterior support 7 (see FIG. 1), whose independent location with respect to bed 6 was indispensable in the on-site mounting (see FIG. 1). There is no need for a reinforced or highly machined bed because the bed only supports bearing 3 and 4. Moreover, the monoblock bed (i.e. housing) minimizes the alignment problems mentioned above. The bed can be built much more economically and requires only factory adjustment.

Figure 3:
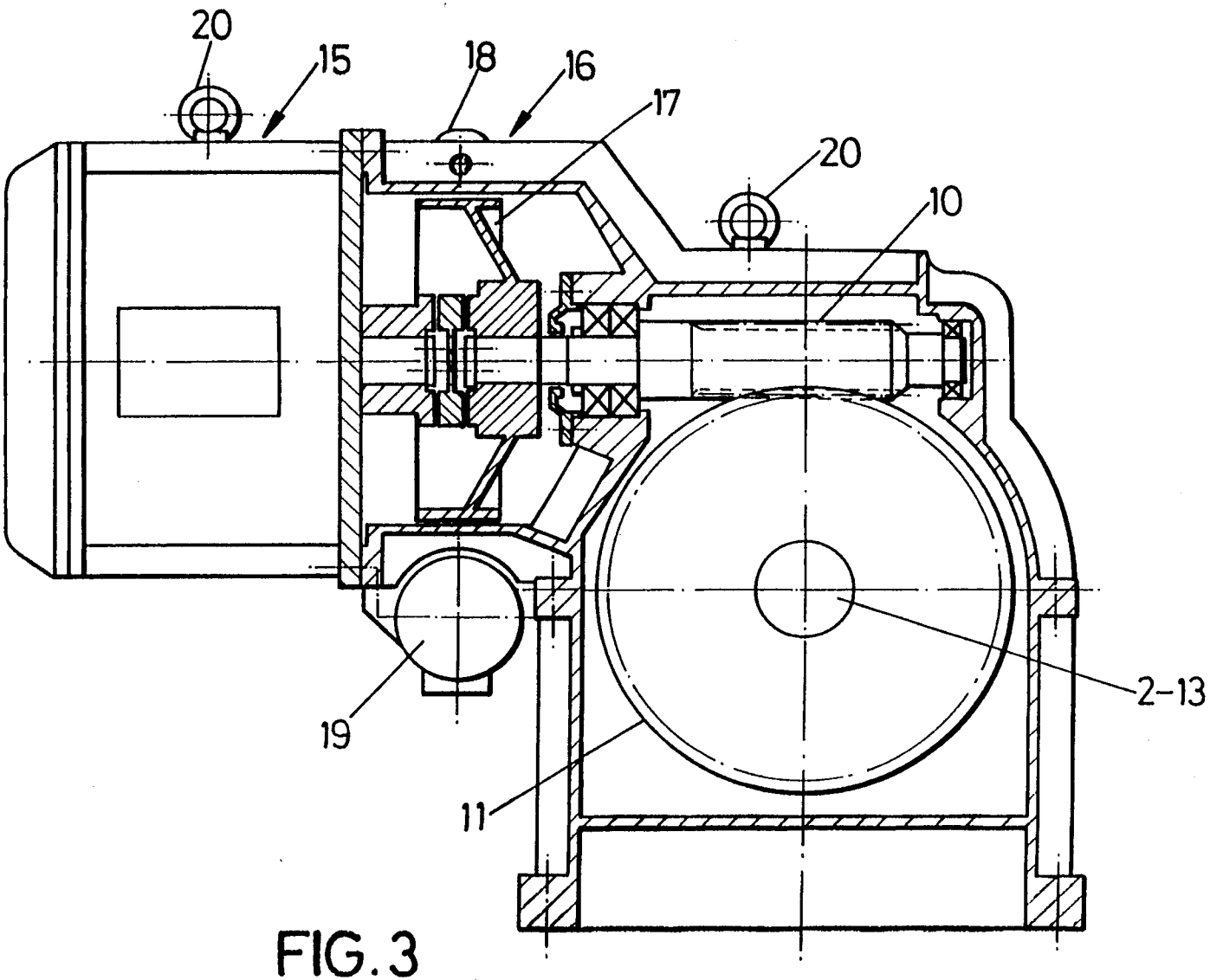
FIG. 3 is a raised lateral view of that which is shown in FIG. 2.

FIG. 3 shows worm gear/ring gear 10-11 according to a lateral view of FIG. 2 as well as the same lateral view of FIG. 1. The input axle is rotated by motor 15 and governed by the brake generally referenced by the number 16; the brake including brake drum 17 and brake pads or bands 18 that are controlled by servo 19 as is known in the art.

In FIG. 4, a specific embodiment of the elevator machine is shown. Bed 14 is of a single piece, which has an area where ring gear 11 penetrates an oil bath. The monoblock bed structure can be transported with the aid of eyebolts 20. To the right of FIG. 4, eyebolt 20 is anchored to support 21 in an "L" which, besides making the assembly rigid, acts as a support to guide 22 for the suspension cable (not shown).

Although the invention has been shown and described with respect to a best mode embodiment thereof, it should be understood by those skilled in the art that various other changes, omissions and additions in the form and detail thereof may be made therein without departing from the spirit and scope of the invention.

We claim:

1. A roped elevator machine comprising:

a motor an input axle driven by said motor at a first rotational speed, a sheave, an output axle for supporting said sheave, said output axle rotating at a second rotational speed, means for cooperating with said input and output axles to alter the speed of rotation of said output axle relative to said input axle, a monoblock housing having only two seats for supporting said output axle, one of said seats being disposed on a first side of said sheave upon the output axle the other of said seats being disposed on a second side of said sheave upon said output axle, said output axle extending axially beyond one of said seats to attach to said means for cooperating.

2. The machine of claim 1 wherein said means for cooperating comprises:

a worm gear cooperating with said input axle, and a ring gear cooperating with said worm gear and said output axle to alter the speed of rotation of said output axle, said output axle extending through and rotating with said ring gear.

3. An elevator machine having a motor driving an input axle which transmits rotational movement to an output axle by speed alteration means, the output axle having a sheave disposed thereupon, wherein an improvement to said machine is characterized by:

a monoblock housing, said housing having only two seats supporting said output axle, each said seats being disposed on a first side or a second side of said sheave upon said output axle, said output axle extending axially beyond one of said seats, said output axle extending through and supporting said speed alteration means.

4. The machine of claim 3 wherein said speed reducing means comprises:

a worm gear cooperating with said input axle, and a ring gear cooperating with said worm gear and said output axle to alter the speed of rotation of said output axle, said output axle extending through and rotating with said ring gear.

* * * * *